US006568780B2

(12) United States Patent
Schantz et al.

(10) Patent No.: US 6,568,780 B2
(45) Date of Patent: May 27, 2003

(54) ENVIRONMENTAL FACTOR DETECTION SYSTEM FOR INKJET PRINTING

(75) Inventors: Christopher A. Schantz, Redwood City, CA (US); Wen-Li Su, Vancouver, WA (US); Algird M. Gudaitis, Vancouver, WA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/845,130

(22) Filed: Apr. 30, 2001

(65) Prior Publication Data

US 2003/0020773 A1 Jan. 30, 2003

(51) Int. Cl.[7] ..... B41J 29/38; B41J 29/393
(52) U.S. Cl. ..... 347/14; 347/17; 347/19
(58) Field of Search ..... 347/10–12, 14, 347/17, 19, 23, 102; 73/29.01, 335.01, 29.05; 324/76.14; 374/18–20, 44, 45

(56) References Cited

U.S. PATENT DOCUMENTS

| | | | | |
|---|---|---|---|---|
| 4,854,160 A | | 8/1989 | Glatt | |
| 4,860,034 A | * | 8/1989 | Watanabe et al. | 346/140 |
| 5,224,373 A | * | 7/1993 | Williams et al. | 73/29.02 |
| 5,387,976 A | | 2/1995 | Lesniak | 347/19 |
| 5,406,315 A | * | 4/1995 | Allen et al. | 347/17 |
| 5,508,826 A | | 4/1996 | Lloyd et al. | 358/501 |
| 5,612,902 A | | 3/1997 | Stokes | 364/526 |
| 5,731,823 A | | 3/1998 | Miller et al. | 347/5 |
| 5,760,913 A | | 6/1998 | Falk | 358/298 |
| 5,818,960 A | | 10/1998 | Gregory, Jr. et al. | 382/167 |
| 5,828,781 A | | 10/1998 | Nakano | 382/167 |
| 5,877,787 A | | 3/1999 | Edge | 347/19 |
| 5,984,446 A | * | 11/1999 | Silverbrook | 347/3 |
| 6,027,201 A | | 2/2000 | Edge | 347/19 |
| 6,030,066 A | | 2/2000 | Li et al. | 347/19 |
| 6,036,298 A | | 3/2000 | Walker | |
| 6,038,374 A | | 3/2000 | Jacob et al. | 395/109 |
| 6,062,137 A | | 5/2000 | Guo et al. | 101/171 |
| 6,076,915 A | | 6/2000 | Gast et al. | 347/19 |
| 6,081,353 A | | 6/2000 | Tanaka et al. | 358/523 |
| 6,128,022 A | | 10/2000 | Dillinger | 345/431 |
| 6,148,159 A | * | 11/2000 | Shiraishi | 399/44 |
| 6,157,469 A | | 12/2000 | Mestha | 358/504 |
| 6,160,968 A | | 12/2000 | Noda | 399/8 |
| 6,164,750 A | | 12/2000 | Subirada et al. | 347/19 |
| 6,178,007 B1 | | 1/2001 | Harrington | 358/1.9 |
| 6,185,004 B1 | | 2/2001 | Lin et al. | 358/1.9 |

FOREIGN PATENT DOCUMENTS

| | | |
|---|---|---|
| JP | 63177176 | 7/1988 |
| WO | WO 98/52762 | 11/1998 |

* cited by examiner

*Primary Examiner*—John Barlow
*Assistant Examiner*—An H. Do

(57) ABSTRACT

An environmental condition detection system for a hardcopy device, such as an inkjet printing mechanism, includes an environmental condition sensor having an optical property which changes in response to a change in an environmental condition, for instance humidity or temperature. The system also has an optical sensor which detects changes in the optical property and generates a signal for a controller that responds by changing an operating parameter of the hardcopy device. A hard copy device having such a environmental condition detection system is also provided, along with a method of determining an environmental condition within which a hardcopy device is operating.

51 Claims, 4 Drawing Sheets

ENVIRONMENTAL FACTOR DETECTION SYSTEM FOR INKJET PRINTING

INTRODUCTION

The present invention relates generally to inkjet printing mechanisms, and more particularly to an optical system for determining an environmental factor which affects printing, such as the humidity and/or temperature where an inkjet printing mechanism is operating, so printing routines may be adjusted to provide fast, high quality output while accommodating these varying environmental conditions.

Inkjet printing mechanisms use pens which shoot drops of liquid colorant, referred to generally herein as "ink," onto a page. Each pen has a printhead formed with very small nozzles through which the ink drops are fired. To print an image, the printhead is propelled back and forth across the page, shooting drops of ink in a desired pattern as it moves. The particular ink ejection mechanism within the printhead may take on a variety of different forms known to those skilled in the art, such as those using piezo-electric or thermal printhead technology. For instance, two earlier thermal ink ejection mechanisms are shown in U.S. Pat. Nos. 5,278,584 and 4,683,481, both assigned to the present assignee, Hewlett-Packard Company. In a thermal system, a barrier layer containing ink channels and vaporization chambers is located between a nozzle orifice plate and a substrate layer. This substrate layer typically contains linear arrays of heater elements, such as resistors, which are energized to heat ink within the vaporization chambers. Upon heating, an ink droplet is ejected from a nozzle associated with the energized resistor. By selectively energizing the resistors as the printhead moves across the page, the ink is expelled in a pattern on the print media to form a desired image (e.g., picture, chart or text).

To clean and protect the printhead, typically a "service station" mechanism is mounted within the printer chassis so the printhead can be moved over the station for maintenance. For storage, or during non-printing periods, the service stations usually include a capping system which hermetically seals the printhead nozzles from contaminants and drying. To facilitate priming, some printers have priming caps that are connected to a pumping unit to draw a vacuum on the printhead. During operation, partial occlusions or clogs in the printhead are periodically cleared by firing a number of drops of ink through each of the nozzles in a clearing or purging process known as "spitting." The waste ink is collected at a spitting reservoir portion of the service station, known as a "spittoon." After spitting, uncapping, or occasionally during printing, most service stations have a flexible wiper, or a more rigid spring-loaded wiper, that wipes the printhead surface to remove ink residue, as well as any paper dust or other debris that has collected on the printhead.

To improve the clarity and contrast of the printed image, recent research has focused on improving the ink itself. To provide quicker, more waterfast printing with darker blacks and more vivid colors, pigment based inks have been developed. These pigment based inks have a higher solids content than the earlier dye-based inks, which results in a higher optical density for the new inks. Both types of ink dry quickly, which allows inkjet printing mechanisms to use plain paper.

Various environmental factors affect inkjet printing routines, servicing routines, and other aspects of printer performance. Unfortunately in the past, there has been no way to economically provide an environmental factor input to a printer controller to allow the controller to modify these printing, servicing and other routines to provide optimum performance in light of the current environmental conditions. One environmental factor, temperature, may currently be monitored using temperature sensing resistors within the inkjet printheads; however, more important to printer performance than temperature is the environmental factor of humidity. Unfortunately, the currently available humidity sensors are far too expensive for the home and small business inkjet printing markets, with manufacturer's material costs for capacitive sensors ranging several dollars per sensor not including the cost of their support electronics, while voltage output humidity sensors currently cost about ten dollars each. Moreover, the currently available capacitive humidity sensors are inaccurate, so their inaccuracy coupled with their high cost renders their use unjustifiable in the home and small business inkjet printing market.

If humidity could be both economically and accurately measured for communication to a printer controller, a variety of performance enhancements could be made based upon knowledge of the ambient humidity. For example, presently to provide optimum performance in varying environmental conditions, inkjet printing, servicing, and other routines are based on a "worst case scenario" assumption of the environmental conditions, here meaning a high humidity environment for printing and a low humidity environment for printhead servicing, as well as for vapor transfer calculations which account for ink evaporation from the pens. In high humidity, the media may already be moist and partially saturated before ever being loaded into a printer, and high humidity increases the drying time of aqueous-based inks. These high humidity conditions may lead to increased cockle of the media, a term referring to the swelling of the paper fibers when saturated with ink, causing a buckling which in extreme conditions may cause the media to buckle so high that the printhead crashes into the media, smearing the printed image and possibly damaging the printhead. Thus, a high humidity assumption increases the dry time delay for the media over that required in normal or low humidity conditions, which slows media throughput while a printer waits for one sheet to dry before depositing the next sheet on top of the previously printed sheet in the output tray. Furthermore, the low humidity assumptions for servicing increase the duration of servicing routines, which further slows media throughput.

Low humidity conditions contribute to hue shift problems, where various components of the ink evaporate over time, for instance by leaking at the printhead/cap sealing interface. In "off axis" printing systems, where the printheads carry only a small supply of ink across the printzone and are replenished with ink delivered from a stationary main ink reservoir through flexible tubing, some of the ink volatiles leach through the tubing walls to atmosphere. Any loss of one ink component changes the ink composition, resulting in changes in ink performance, often manifested as a hue shift in the resulting image. For instance, with fewer volatiles, the resulting ink dispensed by the printhead has a higher concentration of dyes or colorants, yielding a darker image than originally intended. To compensate for these ink composition changes, ambient humidity information may be used for vapor transfer rate calculations to allow for hue adjustment based on calculated dye load changes over time within the inkjet cartridges.

As another example of the impact of this high humidity assumption on printer performance, when performing duplex printing one typical duplexer unit typically holds a sheet after printing the first side for nearly seven seconds before reversing the sheet and beginning printing on the opposite surface. In low humidity conditions, such as in a desert setting, holding a sheet of paper for seven seconds as one would in a humid region unnecessarily delays duplex printing. These same delays are incurred to avoid cockle problems when printing single sided sheets. For pen servicing, it would be desirable to know the ambient humidity so the type of servicing routine performed on the printheads following uncapping and before a print job may be optimized. Additionally, by knowing a humidity history of the printer, vapor transfer rate calculations may be made to determine the amount of ink lost due to evaporation, which then may be used in conjunction with drop counting or other measures to predict when an inkjet cartridge is nearing an empty condition, allowing an operator to be warned before the cartridge runs dry.

Clearly, a variety of different printing, servicing and other performance operations may be adjusted and optimized if only the ambient humidity were input to the printing mechanism. Thus, one goal herein is to provide an environmental factor measurement input to an inkjet printing mechanism, which may use this input to optimize printer performance to provide fast high quality hard copy outputs.

DRAWINGS FIGURES

FIGS. 3 and 4 are enlarged, side elevational views of the service station of FIG. 1, specifically with:

Figure 3:
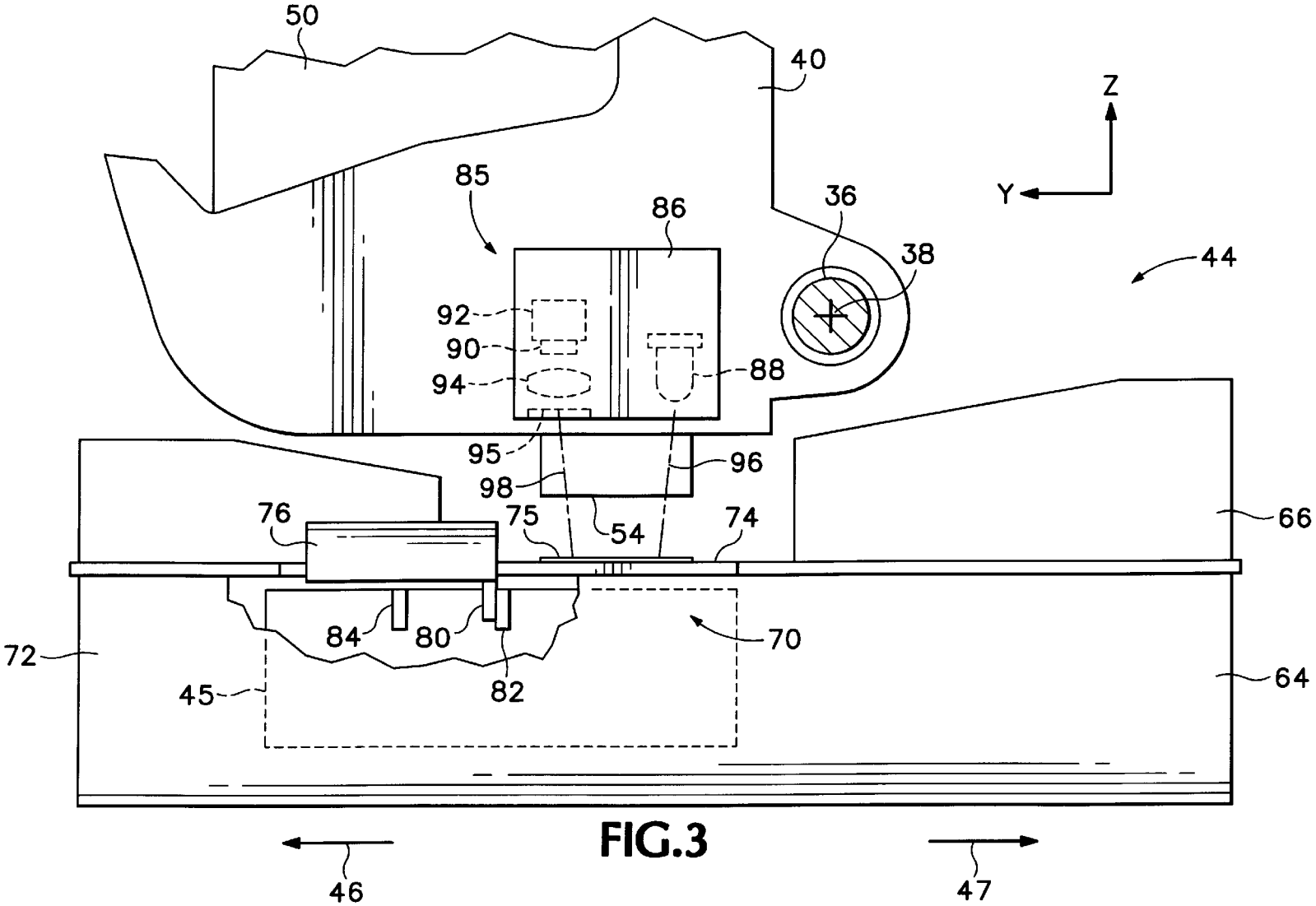
Figure 4:
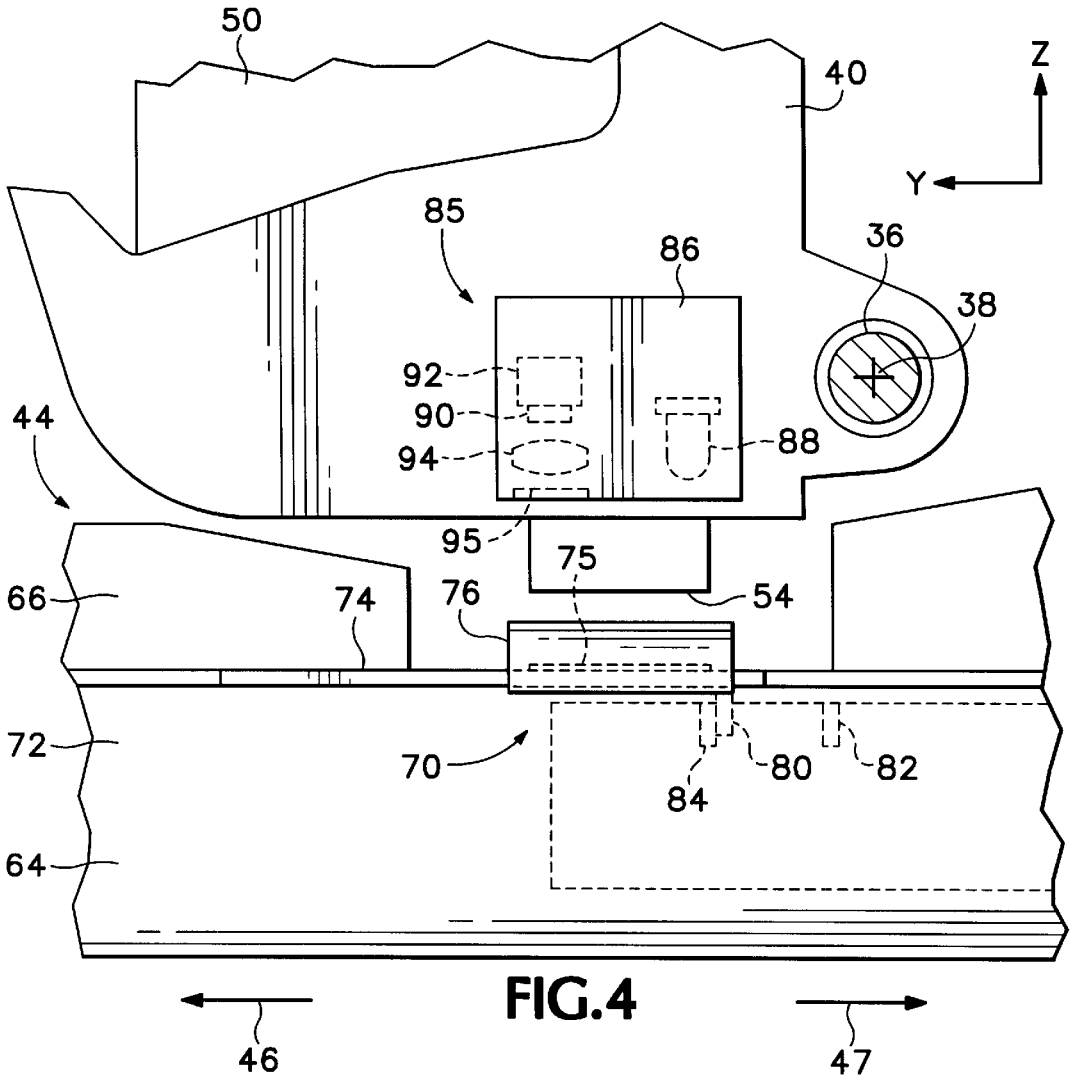

i. FIG. 3 showing a sensor during a detecting operation; and ii. FIG. 4 showing the sensor in a rest position.

Figure 1:
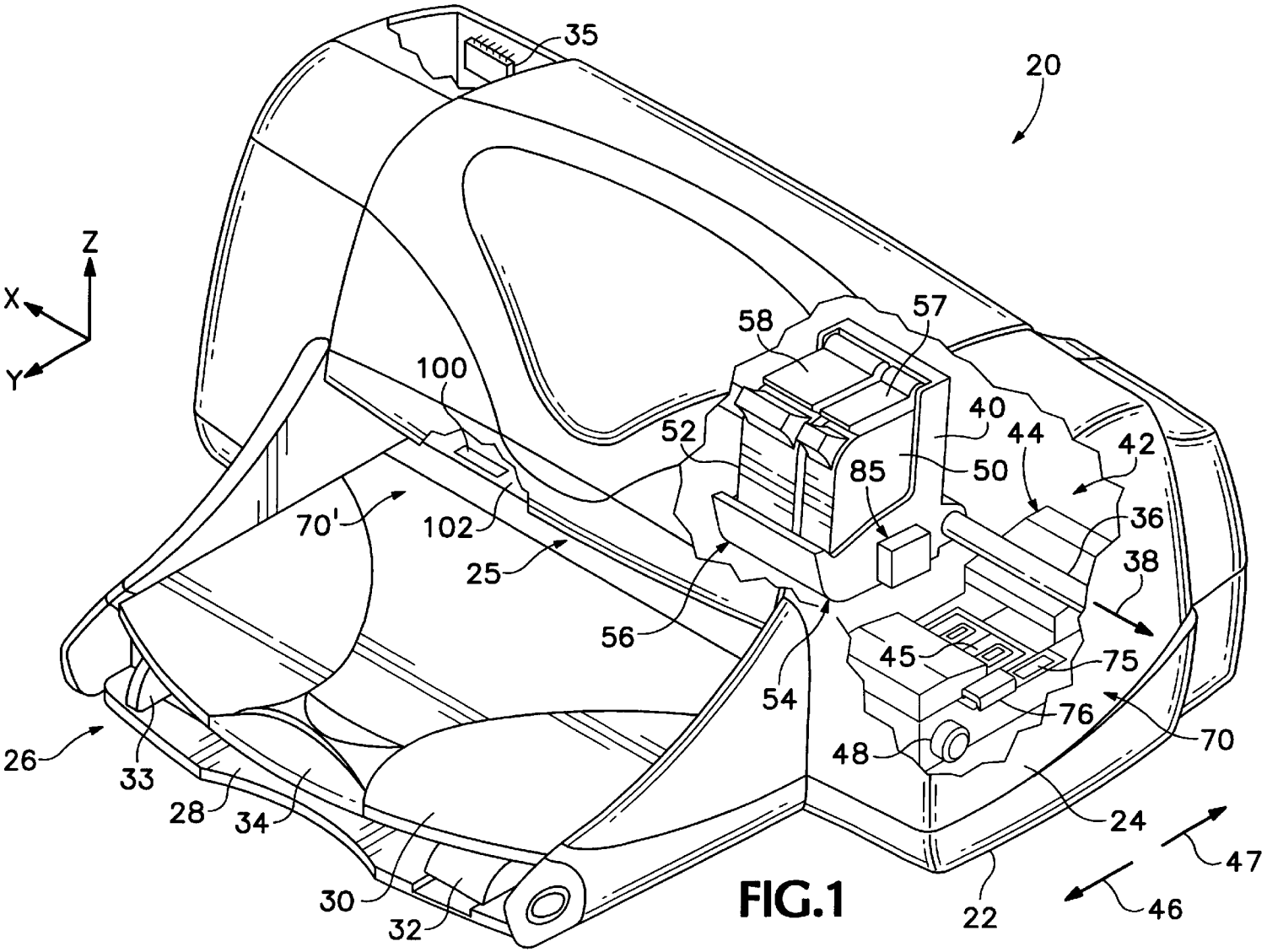
FIG. 1 is a fragmented, partially schematic, perspective view of one form of an inkjet printing mechanism including two different embodiments of an optical humidity and/or temperature sensing system for determining these environmental factors which affect inkjet printing.
Figure 5:
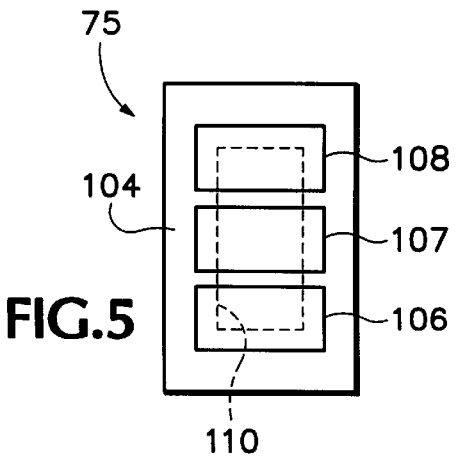

FIG. 5 is an enlarged top plan view of one form of the sensor of FIG. 1.

Figure 6:
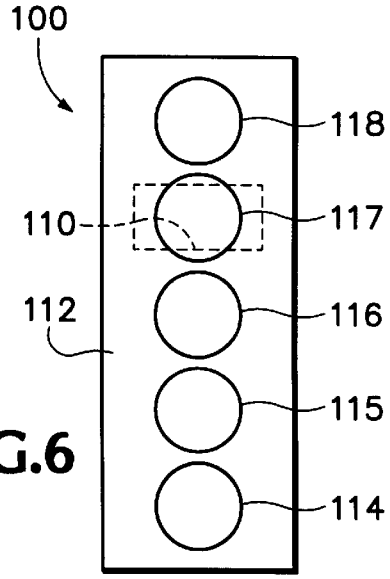

FIG. 6 is an enlarged top plan view of another form of the sensor of FIG. 1.

DETAILED DESCRIPTION

FIG. 1 illustrates an embodiment of an inkjet printing mechanism, here shown as an inkjet printer 20, constructed in accordance with the present invention, which may be used for printing for business reports, correspondence, desktop publishing, and the like, in an industrial, office, home or other environment. A variety of inkjet printing mechanisms are commercially available. For instance, some of the printing mechanisms that may embody the present invention include plotters, portable printing units, copiers, cameras, video printers, and facsimile machines, to name a few. For convenience the concepts of the present invention are illustrated in the environment of an inkjet printer 20.

While it is apparent that the printer components may vary from model to model, the typical inkjet printer 20 includes a chassis 22 surrounded by a housing or casing enclosure 24, typically of a plastic material. Sheets of print media are fed through a printzone 25 by a print media handling system 26, constructed in accordance with the present invention. The print media may be any type of suitable sheet material, such as paper, card-stock, transparencies, fabric, mylar, and the like, but for convenience, the illustrated embodiment is described using paper as the print medium. The print media handling system 26 has a feed tray 28 for storing sheets of paper before printing. A series of conventional motor-driven paper drive rollers (not shown) may be used to move the print media from tray 28 into the printzone 25 for printing. After printing, the sheet then lands on output tray portion 30. Alternatively, the sheet may be directed to pass through a duplexing mechanism, such as a modular duplexing mechanism 31, which turns the sheet over for printing on the opposite surface from the surface first printed upon. One suitable duplexing mechanism is described in U.S. Pat. No. 6,167,231, currently assigned to the present assignee, the Hewlett-Packard Company. The media handling system 26 may include a series of adjustment mechanisms for accommodating different sizes of print media, including letter, legal, A-4, envelopes, etc., such as a sliding length and width adjustment levers 32 and 33 for the input tray, and a sliding length adjustment lever 34 for the output tray.

The printer 20 also has a printer controller, illustrated schematically as a microprocessor 35, that receives instructions from a host device, typically a computer, such as a personal computer (not shown). Indeed, many of the printer controller functions may be performed by the host computer, by the electronics on board the printer, or by interactions therebetween. As used herein, the term "printer controller 35 " encompasses these functions, whether performed by the host computer, the printer, an intermediary device therebetween, or by a combined interaction of such elements. The printer controller 35 may also operate in response to user inputs provided through a key pad (not shown) located on the exterior of the casing 24. A monitor mounted on the casing 24 or coupled to the computer host may be used to display visual information to an operator, such as the printer status or a particular program being run on the host computer. Personal computers, their input devices, such as a keyboard and/or a mouse device, and monitors are all well known to those skilled in the art.

A carriage guide rod 36 is mounted to the chassis 22 to define a scanning axis 38. The guide rod 36 slideably supports a reciprocating inkjet carriage 40, which travels back and forth across the printzone 25 and into a servicing region 42. One suitable type of carriage support system is shown in U.S. Pat. No. 5,366,305, assigned to Hewlett-Packard Company, the assignee of the present invention. A conventional carriage propulsion system may be used to drive carriage 40, including a position feedback system, which communicates carriage position signals to the controller 35. For instance, a carriage drive gear and DC motor assembly may be coupled to drive an endless belt secured in a conventional manner to the pen carriage 40, with the motor operating in response to control signals received from the printer controller 35. To provide carriage positional feedback information to printer controller 35, an optical encoder reader may be mounted to carriage 40 to read an encoder strip extending along the path of carriage travel.

Housed within the servicing region 42 is a service station 44. The service station 44 includes a translationally movable pallet 45, which moves in a forward direction indicated by arrow 46, and in a rearward direction indicated by arrow 47, when driven by a motor 48 operating in response to instructions received from the controller 35. While a variety of different mechanisms may be used to couple the drive motor 48 to the pallet 45, preferably a conventional reduction gear assembly drives a pinion gear which engages a rack gear formed along the undersurface of the pallet 45, for instance as shown in U.S. Pat. Nos. 5,980,018 and 6,132,026, both currently assigned to the present assignee, the Hewlett-Packard Company.

In the printzone 25, the media sheet receives ink from an inkjet cartridge, such as a black ink cartridge 50 and/or a color ink cartridge 52. The cartridges 50 and 52 are also often called "pens" by those in the art. The illustrated color pen 52 is a tri-color pen, although in some embodiments, a set of discrete monochrome pens may be used. While the color pen 52 may contain a pigment based ink, for the purposes of illustration, pen 52 is described as containing three dye based ink colors, such as cyan, yellow and magenta. The black ink pen 50 is illustrated herein as containing a pigment based ink. It is apparent that other types of inks may also be used in pens 50, 52, such as thermoplastic, wax or paraffin based inks, as well as hybrid or composite inks having both dye and pigment characteristics.

The illustrated pens 50, 52 each include reservoirs for storing a supply of ink. The pens 50, 52 have printheads 54, 56 respectively, each of which have an orifice plate with a plurality of nozzles formed therethrough in a manner well known to those skilled in the art. The illustrated printheads 54, 56 are thermal inkjet printheads, although other types of printheads may be used, such as piezoelectric printheads. These printheads 54, 56 typically include a substrate layer having a plurality of resistors which are associated with the nozzles. Upon energizing a selected resistor, a bubble of gas is formed to eject a droplet of ink from the nozzle and onto media in the printzone 25. The printhead resistors are selectively energized in response to enabling or firing command control signals, which may be delivered by a conventional multi-conductor strip (not shown) from the controller 35 to the printhead carriage 40, and through conventional interconnects between the carriage and pens 50, 52 to the printheads 54, 56.

Preferably, the outer surface of the orifice plates of printheads 54, 56 lie in a common printhead plane. This printhead plane may be used as a reference plane for establishing a desired media-to-printhead spacing, which is one important component of print quality. Furthermore, this printhead plane may also serve as a servicing reference plane, to which the various appliances of the service station 45 may be adjusted for optimum pen servicing. Proper pen servicing not only enhances print quality, but also prolongs pen life by maintaining the health of the printheads 54 and 56. To hold the pens, 50, 52 in place securely against alignment datums formed within carriage 40, preferably the carriage 40 includes black and color pen latches 57, 58 which clamp the pens 50, 52 in place as shown in FIG. 1.

Figure 2:
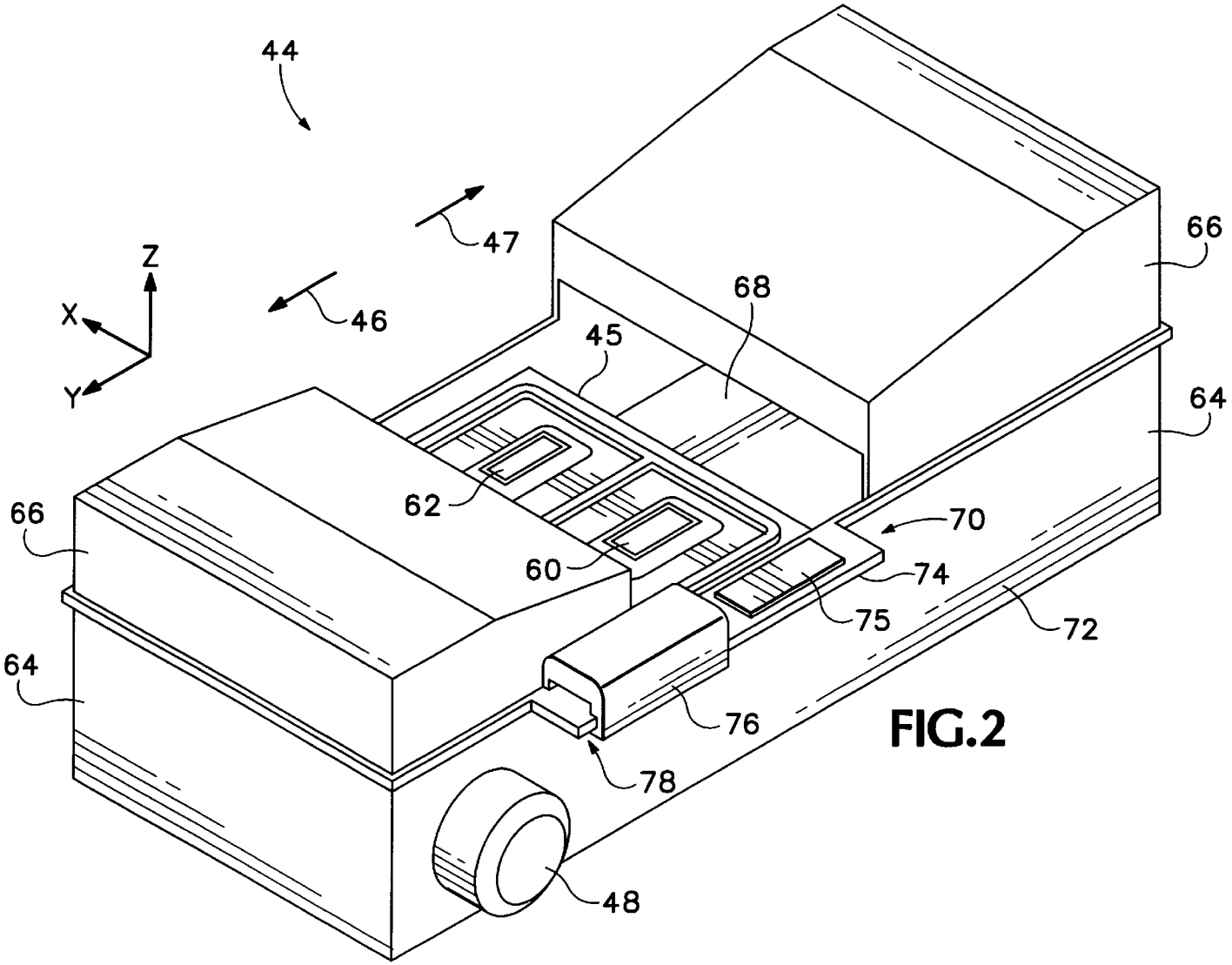
FIG. 2 is an enlarged, perspective view of one form of a service station of FIG. 1.

FIG. 2 shows one form of the service station 44, constructed in accordance with the present invention. The pallet 45 may carry a variety of different servicing members for maintaining the health of the printheads 54, 56, such as printhead wipers, primers, solvent applicators, caps and the like. These various servicing members are represented in the drawing figures as black and color caps 60, 62 for sealing the printheads 54, 56 of pens 50, 52, respectively. Preferably, the pallet 45 is housed between a lower frame portion 64, and an upper frame portion 66 of the service station 44. As mentioned above, the motor 48 drives the pallet 45 in the forward and reverse directions of arrows 46 and 47 to bring the various servicing components into contact with the printheads 54, 56. The frame lower portion 64 preferably defines a waste ink reservoir or spittoon 68, which receives ink purged from the printheads 54, 56 in a spitting routine.

The service station 44 includes an optical environmental factor detection system 70 constructed in accordance with the present invention, here shown as being mounted along an outboard wall 72 of the lower frame 64. As used herein, the term "inboard" refers to items facing toward the printzone 25, and the term "outboard" refers to items facing away from printzone. First an explanation of the construction of the environmental factor detection system 70 will be given, followed by a discussion of its operation. The optical environmental factor detection system 70 includes a platform 74 projecting outwardly from the outboard service station frame wall 72. The platform 74 supports an optical environmental factor indicator member or card 75, which changes its optical appearance in response to various changes in certain environmental factors, as described in further detail below.

FIGS. 2 and 3 show the indicator card 75 open and exposed for reading. To keep the indicator card 75 clean during various printhead servicing routines, such as during a spitting routine where the printheads 54, 56 selectively eject or "spit" ink into the spittoon 68, the detection system 70 may include an indicator cover member, such as a sliding cover 76. Preferably the cover 76 is attached by a guide track, a rail and runner system, or other sliding linkage means to the platform 74 so the cover 76 may move in both the forward direction 46 and the rearward direction 47.

FIGS. 3 and 4 show how the cover 76 is moved from a retracted or rest position shown in FIG. 3, to an active or covering position shown in FIG. 4. In the illustrated embodiment, the pallet 45 is used to transition the cover 76 between these rest and activated positions. Preferably, the cover 76 has an engagement member, such as downwardly extending finger portion 80 which projects downwardly from cover 76 into the spittoon portion 68 of the service station 44. To open the cover, the pallet 45 supports a first engagement member 82, which is shown in FIG. 3 engaging the cover finger member 80 as the carriage 45 moves in the forward direction 46. Located a selected distance away from the first member 82, is a second engagement member 84 which also projects from the pallet 45 to engage the cover finger member 80. As shown in FIG. 4, the second engagement member 84 has engaged the cover finger 80, to move the cover 76 over the indicator card 75 as the pallet 45 moves in the rearward direction 47.

The exact distance used to separate the first and second engagement members 82 and 84 from one another depends upon the type of servicing which is desired to be done to the printheads 54, 56 while the indicator cover 76 is either open or closed. For instance, during spitting and printhead wiping using wipers (not shown) supported by the pallet 45, preferably the cover 76 is closed (FIG. 4). During the capping operation, where the printheads 54, 56 are sealed by the black and color caps 60, 62 during periods of printer inactivity, it would be desirable to have the cover 76 be open, to expose the indicator card 75 for reading (FIG. 3).

To read indicia on the indicator card 75, preferably the optical environmental factor detection system 70 includes an optical sensor 85, such as the monochromatic optical sensor described in U.S. Pat. No. 6,036,298, currently assigned to the present assignee, the Hewlett-Packard Company. The illustrated optical sensor 85 includes a body 86, which in the illustrated embodiment is supported by an outboard side wall of the printhead carriage 40. The body 86 houses several components, including an illuminating element 88, such as a blue or violet-blue light emitting diode ("LED"). The body 86 also houses a photo sensor 90, along with optional electronics for the photo sensor, such as an amplifier 92. The photo sensor 90 receives light through a lens element 94, with the field of view of light passing to lens 94 being limited by a window, or F-stop 95. Optionally, an optical filter (not shown) may be placed in the F-stop window 95. The sensor body 86 may also house additional illuminating elements of different colors, along with additional photo sensors and related lens elements, etc., such as one photo sensor for monitoring diffractive reflection from the card 75, and another photo sensor for monitoring spectral reflection from the card 75. FIG. 3 shows the LED element 88 illuminating the indicator card 75 with an illuminating beam 96. The illuminating beam 96 impacts the indicator card 75, and then reflects off the card to form a reflected beam 98, which passes through any optical filter element, through the F-stop 95, and through lens 94, before being received by the photo sensor 90.

The optical environmental factor detection system 70 described thus far, may be considered as a static detection system, because the printhead carriage 40 remains fixed in a stationary location while viewing the indicator 75. FIG. 1 shows an optional alternative embodiment, a moving optical environmental factor detection system 70' may be employed instead of, or in conjunction with, the detection system 70. In the illustrated movable detection system 70', an optical environmental indicator member or card 100 is mounted in the printzone 25 to a portion of the media support system, here shown as a platen 102. In the illustrated embodiment, the indicator card 100 is located toward the far left of the platen 102, remote from the service station 44, to avoid having the indicator card 100 become contaminated with ink aerosol generated by printheads 54, 56 during spitting routines over the service station spittoon 68. Preferably, the indicator card 100 is mounted along the platen 102 in a position where the optical sensor 85 will pass over the indicator card when slewing or reciprocating back and forth across the printzone 25 in the direction of the scanning axis 38.

FIG. 5 illustrates one form of the indicator card 75, constructed in accordance with the present invention. Preferably the indicator card 75 has a backing layer 104 which is adhered or bonded to the support platform 74. In some embodiments, the backing layer 104 may be impregnated with various concentrations of a material which reacts to changes in the temperature, relative humidity, or other environmental factors. For instance, to detect changes in the relative humidity, the illustrated backing layer 104 may be constructed of a porous media, such as of a blotter type of paper which has been impregnated with a known concentration of cobalt chloride solution, such as indicated in FIG. 5 by sensor block 106. By monitoring the color changes of a single block 106, which in the illustrated example transitions from a blue color if the humidity is lower than a selected reference value, through a lavender ("Lav.") color near the known value, to a pink color when the humidity is above the known value, as indicated in Chart 1 below where the known value is indicated as X % of relative humidity.

CHART 1

| | Color of Sensor Block 106 | | |
|---|---|---|---|
| Humidity: | Dry | X % | Humid |
| Sensor 106: | Blue | Lavender | Pink |

In Chart 1 above, the terms "dry" and "humid" are used to assist the reader in understanding which end of the scale refers to which condition. For instance, a "dry" condition normally is associated with a desert environment, whereas a "humid" condition normally being associated with a tropical environment, although it is apparent that during a cloud burst a desert may become a very humid environment for a short period of time.

A further increase in accuracy may be obtained by adding a second cobalt chloride indicia 107 to the backing layer 104, here selected to react at a different relative humidity than the first indicia 106. For instance, if the indicia 107 reacted at a higher relative humidity than indicia 106, for instance, at a value of Y %, then the color changes of indicia 106 and 107 with respect to changes in the relative humidity may be as indicated below in Chart 2.

CHART 2

| | Color of Sensor Blocks 106 & 107 | | | | |
|---|---|---|---|---|---|
| Humidity: | Dry | X % | X-Y % | Y % | Humid |
| Sensor 106: | Blue | Lav. | Pink | Pink | Pink |
| Sensor 107: | Blue | Blue | Blue | Lav. | Pink |

Indeed, greater degrees of accuracy and humidity measurement may be obtained by adding a third indicia 108 to the indicator card 75. If this third indicia 108 were formulated with a cobalt chloride concentration to react in a higher humidity than either indicia 106 or 107, for instance, at a relative humidity of Z %, then the operation of the indicator card 75 is as shown in Chart 3 below.

CHART 3

| | Color of Sensor Blocks 106–108 | | | | | | |
|---|---|---|---|---|---|---|---|
| Humidity: | Dry | X % | X-Y % | Y % | Y-Z % | Z % | Humid |
| Sensor 106: | Blue | Lav. | Pink | Pink | Pink | Pink | Pink |
| Sensor 107: | Blue | Blue | Blue | Lav. | Pink | Pink | Pink |
| Sensor 108: | Blue | Blue | Blue | Blue | Blue | Lav. | Pink |

Additional indicia may be added to the indicator card 75, although in the illustrated embodiment where the indicator card 75 is mounted stationarily to the service station support platform 74, the amount of physical room available for viewing these indicia 106–108 is limited in a practical sense in the illustrated embodiment by a field of view 110, as indicated in dashed lines in FIG. 5, which is established by the optical sensor field stop 95. In the illustrated embodiment, the current commercial embodiment of one preferred optical sensor 85 may be of the same construction as that sold in the DeskJet® 990 model color inkjet printer by the Hewlett-Packard Company. The illustrated sensor 85 has a field of view 110 based on the size of the window opening of F-stop 95, which is on the order of 1 mm (millimeter) by 2 mm.

In our first example for indicator card 75, where only a single indicia 106 was used (see Chart 1 above), preferably the indicia 106 spans to cover the entire field of view 110 of the optical sensor 85. Similarly, if only two indicia 106 and 107 were placed on the indicator card 75, their shape and position are expanded to encompass the greatest portion of the field of view 110. FIG. 5 illustrates the field of view 110 for a three indicia card 75 having indicia 106–108. The overlap of the indicia 106–108 beyond the edges of the field of view 110 are provided to minimize any reflectance from the backing layer 104, and to thereby provide a more accurate reading to the photo sensor 90.

Similarly, for the moving carriage optical environmental factor detection system 70', one embodiment of an indicator card 100 is shown in FIG. 6, as having a backing layer 112. In this illustrated embodiment, the backing layer 112 is a sheet of cardstock, which has an under surface coated with an adhesive layer that is bonded to the platen 102, as shown in FIG. 1. In the illustrated embodiment, the backing layer 112 has an upper surface to which are bonded a series of indicator blotter paper cutouts 114, 115, 116, 117 and 118, with each indicia or indicator spot 114–118 being saturated with a different concentration of cobalt chloride to detect gradual changes in humidity. For instance, stepwise changes in relative humidity between adjacent indicia may be 5%, 10%, 15%, 20%, etc. depending upon the particular implementation. Moreover, equal steps between each of the indicia 114–118 are not required if the printing systems of printer 20 are not sensitive over certain bandwidths. For instance, only under very dry conditions on the order of 10–20% relative humidity, or under very humid conditions on the order of 80–90% relative humidity, the print routines may be affected, while conditions between these extremes, for instance on the order of 30–70% relative humidity, are considered to be in a normal operating range, where print modes are unaffected by humidity. In such an example, indicia 114 may be impregnated to change color at 10% relative humidity, indicia 115 at 20% relative humidity, indicia 116 at 50% relative humidity, indicia 117 at 80% relative humidity, and indicia 118 at 90% relative humidity.

In this 10/20/50/80/90% relative humidity example for constructing the indicator card 100, the carriage 40 moves the optical sensor 85 sequentially over each of the indicia 114–118, or in reverse order from indicia 118 to indicia 114, looking for a color change from pink to blue to find a lavender transition region indicating the current relative humidity. For instance, if the optical sensor 85 found that the indicia 114, 115 and 116 were all of a pink color, indicia 117 was of a lavender color, and indicia 118 was of a blue color, then the controller 35 interprets the ambient conditions to be at 80% relative humidity. At this higher (80%) humidity, printing routines may be slowed to allow more time for volatiles within the inks to dry. Additionally, a time delay may be inserted between printing sheets in a multiple sheet print job, allowing a previously printed sheet to dry before the next sheet is dropped upon it in the output tray 30 to avoid smearing the earlier printed sheet. This delay or dry time may be adjusted, such as by increasing the dry time delay in high humidity conditions and decreasing the dry time delay in low humidity conditions. In an inkjet printing mechanism having auxiliary drying capability, such as in printers having internal heaters, additional heat may be applied in high humidity conditions to speed drying of the ink and reduce the drying time to a shorter interval.

As another example, if instead the indicia 115 was lavender, and indicia 114 was of a pink color, and indicia 116–118 were of a blue color, then the controller 35 interprets this information from sensor 85 as being 20% relative humidity. Under these relatively dry (20%) conditions, print speeds may be increased because dry conditions allow the volatiles within the inks to dry more quickly. For instance, during duplex printing operations, where there is normally a seven second delay time between printing a first side of a sheet and a second side, the delay time may be decreased from a nominal seven second delay time to three or four seconds.

Thus, by allowing the printer controller 35 to understand through the use of the environmental factor detection system 70, 70' that the printer is in a humid environment, in this example above 80% humidity, print quality is increased by allowing additional dry time for the inks on multiple page print jobs. Similarly, by allowing the controller 35 to know the printer is in a relatively dry environment, here less than 20% relative humidity, throughput is increased by eliminating some of the additional dry time required during nominal conditions especially in duplex printing. Of course, the controller 35 uses carriage positional feedback information, such as from the conventional encoder system mentioned above, to interpret which of the indicia 114–118 the optical sensor 85 is currently viewing. Moreover, while circular indicia 114–118 are illustrated in FIG. 6, and rectangular indicia 106–108 are shown in FIG. 5, it is apparent that either of these indicia shapes, or other shapes, may be used in various implementations.

While thus far, the illustrated embodiments have been described in terms of humidity sensors, it is apparent that the indicator card 75, 100 may be constructed to measure other environmental factors, such as temperature. For measuring changes in temperature, the blotter material of indicia 106–108, 114–118 may be impregnated with thermochromatic materials which change color in response to temperature changes. Alternatively, the indicator cards 75, 100 may carry a cholesteric liquid crystal temperature sensitive material which changes appearance in response to color changes, which are commercially available. For instance, some of these liquid crystal temperature indicator strips change from a black to a white color so the temperature value is readable against a white background, with all other temperature values being blacked out. Thus, the optical sensor 85 would detect the position of the white band parallel to the scan axis 38, then the controller 35 would correlate the location of the white band with the ambient temperature, with the location versus temperature relationship being previously stored or calibrated in the controller's memory.

One flaw of the currently available humidity indicator cards studied thus far is their tendency to wash out when exposed to humidities in excess of 90% over a period of 36 hours or longer. Such a circumstance could be read by the optical sensor 85 and communicated to controller 35. Upon receiving information that the indicator card 75, 100 has washed out, that is, turned a whitish-pink color, depending upon the color of indicia 114 the controller 35 may then alert an operator of this condition, and/or default to the nominal printing routine using a worst case assumption that the printer 20 is permanently located in a humid environment, thereby sacrificing printing speed and throughput in favor of maintaining high print quality.

Another drawback of the currently available indicator cards 75, 100 is the temperature sensitivity of the indicia 106–108, 114–118. For instance, at temperatures of 75° F. (22° C.) the currently available indicia have an accuracy of within +/−5%. At other temperatures, a small correction factor of 2.5% for each 10° F. (5.5° C.) temperature variation higher or lower than 75° F. may be taken into consideration by the controller 35, assuming the controller has a temperature input. For instance, at higher temperatures the indicia 106–108, 114–118 indicate a lower humidity than is actually the case, while at lower temperatures, higher humidities than ambient are indicated. As mentioned above, ambient temperature sensing may be accomplished using temperature sensing resistors onboard the printheads 54, 56. Alternatively, a temperature sensitive indicator card may be supported by platen 102, either instead of or in addition to, the humidity indicator card 100. As another alternative embodiment, the indicator card 100 may be fashioned with temperature sensitive indicia 114–118, with humidity being measured at the stationary indicator card 75. Thus, optical measurements of the temperature may be made by sensor 85, followed by humidity measurements which are then adjusted by controller 35 according to the ambient temperature if needed.

Furthermore, while the indicia 106–108 and 114–118 have been described in terms of changing color or hue in response to various changes in the ambient environmental conditions, it is apparent that indicia having other properties which change according to these environmental conditions may also be used. For instance, the indicia may get lighter or darker in response to changing environmental conditions. As another example, the indicia may have surface property characteristics which change in response to changing environmental conditions. For instance, if the indicator card 75, 100 had indicia which transitioned between a smooth state under dry conditions, and a wrinkled or ruffled state when humid, then these various changes in surface characteristics may also be monitored by the optical sensor 85. Other indicia carried by indicator cards 75, 100 may include those which change opacity, roughness, reflectance, saturation, shade and the like. Moreover, while changing of colors has been described with respect to colors which are visually observable to the human eye, the color change may be in ranges beyond those perceivable to humans, such as colors in the infrared and ultraviolet range, as long as the optical sensor 85 is calibrated to detect such color changes.

Given the current state of the art in the surface mounted humidity indicator field, color change accuracies of the indicia 106–108, 114–118, are within +/−5% relative humidity. In some instances, upon paying of a premium, tighter quality controls may be implemented and these accuracies may be decreased to +/−3% relative humidity. As mentioned in Introduction section above, the earlier capacitive humidity sensors are currently available at a cost of approximately several dollars each not including the cost of their support electronics while voltage output humidity sensors cost about ten dollars each. In contrast, using the illustrated indicator cards 75, 100, and buying in quantities, the cost of each indicator card may be on the order of 5–15 cents, which imposes very little additional cost on the overall printer 20, while at the same time greatly improving performance. Moreover, if the optical sensor 85 is already installed in the printing unit for monitoring the media and/or ink droplets printed on a page, there is no additional cost associated with adding the optical sensor as an indicator card reader.

There are various advantages associated with either the stationary environmental factor detection system 70, as well as with the moving environmental factor detection system 70'. In the moving detection system 70 ', higher resolution may be obtained by increasing the number of indicia on the indicator card 100, or by providing several indicator cards having different calibrations. Furthermore, the moving system 70' using a humidity sensor indicator card 100 is able to obtain dry time information more quickly than the stationary system 70 because there is no need to traverse the sensor 85 into the servicing region 42. Furthermore, the moving detection system 70', as well as the stationary system 70, using indicator card 100 gives information which is useful for calibrating the spit time required following uncapping of the printheads 54, 56 by caps 60, 62.

In contrast, the stationary optical environmental factor detection system 70 may operate to collect environmental data over time, storing this data within a storage portion of controller 35. This monitoring of the various environmental factors by the stationary system 70 is advantageously accomplished without requiring the carriage 40 to move. Specifically, by obtaining a humidity history using the stationary sensor 70, the water vapor transfer rate may be calculated to accommodate for evaporation of the inks from within pens 50, 52 over time. This water vapor transfer rate, in addition to counting the number of droplets fired by each printhead 54, 56 may be used to predict the amount of ink remaining in each of the pens 50, 52. Thus, a capping history of environmental conditions, here humidity, while the pens have been capped may be gathered. For example, under higher humidity conditions, the printheads 54, 56 are less susceptible to clogging. Thus, under high humidity conditions fewer drops need to be expended during pre-printing spitting routines.

As mentioned in the Introduction section above, low humidity conditions also contribute to hue shift problems, where various components of the ink, such as water or volatiles, evaporate or dissipate over time, for instance by leaking at the printhead/cap sealing interface or through ink delivery tubing in off axis printing systems. If the controller 35 has a record of the changes in the ambient humidity, and knows the rates of evaporation overtime under these humidity conditions, the controller may estimate the change(s) in ink composition over the lifetime of an ink supply. Knowing these changes in the ink composition over time, the controller 35 may then compensate for these changes by conducting vapor transfer rate calculations, for instance, by printing fewer dots per unit area for an aged printhead having a higher concentration of dyes or colorants due to evaporated volatiles. Thus, the controller may compensate for these ink composition changes to allow for hue adjustment based on calculated dye load changes over time within the inkjet cartridges. Furthermore, this evaporation information may be used by the controller 35 to more accurately predict an upcoming out of ink condition when used in conjunction with a drop-counting or other system for anticipating when the pens 50, 52 may run dry. For instance, a simple drop-counting routine may indicate an abundant ink supply remains and fail to give an operator any warning, while in reality, the pen is nearly dry due to evaporation and a warning should be given to tell the operator to have a replacement cartridge on hand.

Additionally, use of either the stationary system 70 or the moving system 70' allows the various print modes to be adjusted based on environmental conditions. As mentioned above, during duplex printing jobs throughput may be adjusted to correspond to the various changes in ambient temperature and humidity, to increase throughput and/or improve print quality over results obtained using nominal or worst case assumptions about environmental conditions. Furthermore, using the stationary detection system 70 equipped for humidity monitoring allows for variations in the pre-print mode servicing routines, as well as other servicing routines performed during print jobs. For example, under dry conditions the nozzles of both of the printheads 54, 56 are more subject to clogging, so to accommodate for this, pre-print spitting routines may be more vigorous than required under nominal conditions. Additionally, knowing this various information about environmental factors influencing printer 20 may allow for more accurate line feed calibration, which refers to the advancing of the media through the printzone 25. Line feed calculations may be impacted by expansion and contraction of the media path encoder disk, which is used to track the movement of the media through the printzone 25. In some embodiments, the encoder disk may absorb water so in a humid environment the disk expands, adding a nominal offset to the timing of the counts as an optical sensor reads equally-spaced radial lines appearing near the disk periphery. Additionally, other media movement path components, such as drive rollers, may change shape or enlarge due to high ambient moisture conditions, impacting line feed accuracy for longer media advances which are more sensitive to runout errors in both the drive rollers and in the encoder feedback system.

We claim:

1. An environmental condition detection system for a hardcopy device, comprising: an environmental condition sensor having an optical property which changes in response to a change in an environmental condition, said environmental condition sensor comprising a base material treated with a solution of a color-changing material which changes color in response to said change in said environmental condition, said base material being of an absorbent material having a first region which has absorbed said solution having a first concentration of said color-changing material, and a second region which has absorbed said solution having a second concentration of said color-changing material, with said second concentration being different from said first concentration, and with said first region changing color in response to a first change in said environmental condition, and said second region changing color in response to a second change in said environmental condition different from said first change; and an optical sensor which detects said change in the optical property and generates a signal in response thereto.

2. An environmental condition detection system according to claim 1 wherein said environmental condition comprises temperature, and said environmental condition sensor comprises a temperature sensor.

3. An environmental condition detection system according to claim 1 wherein said environmental condition comprises humidity, and said environmental condition sensor comprises a humidity sensor.

4. An environmental condition detection system according to claim 1 wherein said optical sensor moves between the first and second regions.

5. An environmental condition detection system according to claim 1 wherein the optical sensor remains stationary while detecting any color changes in the first and second regions.

6. An environmental condition detection system according to claim 1 further including a second environmental condition sensor having another optical property which changes in response to a change in another environmental condition, wherein the optical sensor detects said change in said another optical property and generates another signal in response thereto.

7. An environmental condition detection system according to claim 6 wherein said another optical property of said second environmental condition sensor comprises another color-changing region which changes color in response to said change in said another environmental condition.

8. An environmental condition detection system according to claim 7 wherein said optical sensor moves between said environmental condition sensor and said second environmental condition sensor.

9. An environmental condition detection system according to claim 1 wherein said solution comprises a cobalt chloride and the hardcopy device comprises an inkjet printing mechanism.

10. A method of determining an environmental condition within which a hardcopy device is operating, comprising: exposing a sensor to an environmental condition, with the sensor having an optical property which changes in response a change to said environmental condition; optically observing said sensor; thereafter, generating a signal in response to said optical property of the sensor; exposing another sensor to another environmental condition, with said another sensor having another optical property which changes in response a change to said another environmental condition; said optically observing comprises observing said another sensor; and thereafter, generating another signal in response to said another optical property of said another sensor; wherein said optically observing comprises using an optical sensor to observe said sensor and said another sensor, and moving said optical sensor between said sensor and said another sensor.

11. A method according to claim 10 wherein said optical property comprises color and said another property comprises another color.

12. A method according to claim 10 wherein said environmental condition comprises humidity, and said another environmental condition comprises temperature.

13. A method of determining an environmental condition within which a hardcopy device is operating, comprising: exposing a sensor to an environmental condition, with the sensor having an optical property which changes in response a change to said environmental condition; optically observing said sensor wherein said optically observing comprises using an optical sensor to observe said sensor, and holding said optical sensor stationary while observing said sensor; and thereafter, generating a signal in response to said optical property of the sensor.

14. A method according to claim 13 wherein said optical property comprises color.

15. A method according to claim 14 further comprising changing said color in response said change comprising a selected change in said environmental condition.

16. A method according to claim 13 wherein said optical property changes in response to said environmental condition comprising temperature.

17. A method according to claim 16 wherein said optical property comprises color.

18. A method according to claim 13 wherein said optical property changes in response to said environmental condition comprising humidity.

19. A method according to claim 18 wherein said optical property comprises color.

20. A method according to claim 13 wherein said hardcopy device comprises an inkjet printing mechanism.

21. A method of operating a hardcopy device including an inkjet printing mechanism having a printhead which selectively dispenses ink, comprising: exposing a sensor to an environmental condition within which said hardcopy device is operating, with the sensor having an optical property which changes in response a change to said environmental condition; optically observing said sensor; thereafter, generating a signal in response to said optical property of the sensor; collecting a history of said environmental condition during a period of printhead inactivity; analyzing said history; and adjusting an operating parameter of said hardcopy device in response to said signal, wherein said adjusting comprises adjusting a printhead servicing routine in response to said analyzing.

22. A method according to claim 21 wherein said environmental condition comprises humidity, said servicing routine comprises purging a selected amount of ink from the printhead, and said adjusting comprises reducing the selected amount of ink purged during said servicing under high humidity conditions.

23. A method of operating a hardcopy device including an inkjet printing mechanism having a printhead, the method comprising: exposing a sensor to an environmental condition within which said hardcopy device is operating, with the sensor having an optical property which changes in response a change to said environmental condition; optically observing said sensor; thereafter, generating a signal in response to said optical property of the sensor; adjusting an operating parameter of said hardcopy device in response to said signal;

selectively dispensing ink from the printhead according to a printing routine; collecting a history of said environmental condition during printhead inactivity; and analyzing said history to estimate an amount of ink evaporated from said printhead during said period of inactivity.

24. A method according to claim 23 further comprising:

compiling the amount of ink dispensed from the printhead from when the printhead was initially installed in the printing mechanism; and estimating the amount in ink remaining in an ink supply coupled to the printhead in response to said analyzing and said compiling.

25. A method according to claim 24 further comprising:

predicting an upcoming out of ink condition from said estimating; and alerting an operator of said upcoming out of ink condition.

26. A method according to claim 23 wherein said adjusting comprises adjusting the printing routine in response to said analyzing.

27. A method according to claim 26 wherein:

said analyzing comprises determining an amount of ink volatiles evaporated from said printhead during said period of inactivity;

wherein said adjusting comprises adjusting the printing routine to compensate for said evaporated volatiles.

28. A method of operating a hardcopy device including an inkjet printing mechanism having a printhead, the method comprising: exposing a sensor to an environmental condition within which said hardcopy device is operating, with the sensor having an optical property which changes in response a change to said environmental condition; optically observing said sensor; thereafter, generating a signal in response to said optical property of the sensor; advancing media through a printzone of the printing mechanism; selectively dispensing ink from the printhead onto the media while in the printzone; and adjusting an operating parameter of said hardcopy device in response to said signal, wherein said adjusting comprises adjusting the advancing step.

29. A method according to claim 28 wherein said environmental condition comprises humidity.

30. A hardcopy device for interacting with media, the hardcopy device including an inkjet printing mechanism for printing on a sheet, the hardcopy device comprising: a printhead which selectively dispenses ink and interacts with said media when in a printzone; a media handling system which advances the media through the printzone; an environmental condition sensor having an optical property which changes in response to a change in an environmental condition within which the hardcopy device operates; an optical sensor which detects said change in the optical property and generates a signal in response thereto; and a controller which collects a history of said environmental condition during a period of printhead inactivity and analyzes said history, and adjusts an operating parameter of said hardcopy device in response to said signal, said operating parameter comprising a servicing routine which services the printhead.

31. A hardcopy device according to claim 30 wherein said environmental condition comprises temperature, and said environmental condition sensor comprises a temperature sensor.

32. A hardcopy device according to claim 31 wherein said optical property of the temperature sensor comprises one color which changes to another color in response to a selected change in temperature.

33. A hardcopy device according to claim 30 wherein said environmental condition comprises humidity, and said environmental condition sensor comprises a humidity sensor.

34. A hardcopy device according to claim 33 wherein said optical property of the humidity sensor comprises a first color which changes to a second color in response to a selected change in humidity.

35. A hardcopy device according to claim 34 wherein:

said selected change in humidity comprises a first humidity level; and said optical property of the humidity sensor changes from said second color to a third color when the humidity is above said first humidity level.

36. A hardcopy device according to claim 35 wherein said first color comprises a blue color, said second color comprises a lavender color, and said third color comprises a pink color.

37. A hardcopy device according to claim 30 wherein said optical property of the sensor comprises a first color-changing region which changes color in response to a first selected change in said environmental condition.

38. A hardcopy device according to claim 37 wherein said optical property of the sensor further comprises a second color-changing region which changes color in response to a second selected change in said environmental condition.

39. A hardcopy device according to claim 38 wherein:

interaction head reciprocates across the interaction zone; and optical sensor moves with the interaction head to transport the optical sensor between the first and second color-changing regions.

40. A hardcopy device according to claim 38 wherein the optical sensor remains stationary while detecting any color changes in the first and second color-changing regions.

41. A hardcopy device according to claim 30 further including a second environmental condition sensor having another optical property which changes in response to a change in another environmental condition, wherein the optical sensor detects said change in said another optical property and generates another signal in response thereto.

42. A hardcopy device according to claim 41 wherein:

said optical property of said environmental condition sensor comprises a color-changing region which changes color in response to said change in said environmental condition; and said another optical property of said second environmental condition sensor comprises another color-changing region which changes color in response to said change in said another environmental condition.

43. A hardcopy device according to claim 42 wherein:

the interaction head reciprocates across the interaction zone; and the optical sensor moves with the interaction head to transport the optical sensor between said environmental condition sensor and said second environmental condition sensor.

44. A hardcopy device according to claim 30 wherein said environmental condition sensor comprises a base material treated with a solution of cobalt chloride.

45. A hardcopy device according to claim 30 wherein:

said environmental condition comprises humidity and temperature; and the servicing routine purges a selected amount of ink from the printhead, and the controller adjusts the selected amount of ink purged in accordance with the humidity and temperature.

46. A hardcopy device according to claim 30 wherein said environmental condition sensor comprises a base material carrying a cholesteric liquid crystal material, and said environmental condition comprises temperature.

47. A hardcopy device for interacting with media, the hardcopy device including an inkjet printing mechanism for printing on a sheet, the hardcopy device comprising: a printhead which selectively dispenses ink in a printzone from an ink supply while printing according to a printing routine; a media handling system which advances the media through the printzone; an environmental condition sensor having an optical property which changes in response to a change in an environmental condition within which the hardcopy device operates; an optical sensor which detects said change in the optical property and generates a signal in response thereto; and a controller which adjusts an operating parameter of said hardcopy device in response to said signal; wherein the controller compiles a history of said environmental condition during printhead inactivity, analyzes the history to estimate an amount of ink evaporated from the printhead, compiles an amount of ink dispensed from the printhead from when the printhead was initially installed in the printing mechanism, and estimates an amount of ink remaining in the ink supply.

48. A hardcopy device according to claim 47 further wherein the controller predicts an upcoming out of ink condition from the estimate of the amount of ink remaining in the ink supply, and alerts an operator of said upcoming out of ink condition.

49. A hardcopy device according to claim 47 wherein the controller adjusts the printing routine in response to the estimate of the amount of ink remaining in the ink supply.

50. A hardcopy device according to claim 47 wherein the controller determines an amount of ink volatiles evaporated from said printhead during inactivity, and adjusts the printing routine to compensate for the evaporated ink volatiles.

51. A hardcopy device for interacting with media, the hardcopy device including an inkjet printing mechanism for printing on a sheet, the hardcopy device comprising: a printhead which interacts with said media when in a printzone; a media handling system which advances the media through the printzone according to a media advancing routine; an environmental condition sensor having an optical property which changes in response to a change in humidity; an optical sensor which detects said change in the optical property and generates a signal in response thereto; and a controller which adjusts the media advancing routine in response to said signal.

* * * * *